US006256963B1

(12) United States Patent
Kim

(10) Patent No.: US 6,256,963 B1
(45) **Date of Patent: *Jul. 10, 2001**

(54) TABLET CASSETTE FOR AUTOMATIC TABLET SORTING AND COUNTING MACHINE

(76) Inventor: Jin S. Kim, 100-23, Galsandong, Dalsuhgu, Taegu (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/693,091

(22) Filed: Oct. 23, 2000

Related U.S. Application Data

(63) Continuation-in-part of application No. 09/353,199, filed on Jul. 14, 1999, now Pat. No. 6,170,229.

(51) Int. Cl.[7] ..... B65B 35/06; B65H 3/00
(52) U.S. Cl. ..... 53/155; 53/238; 221/265
(58) Field of Search ..... 53/168, 154, 155, 53/237, 238, 445, 474; 221/265

(56) References Cited

U.S. PATENT DOCUMENTS 6,170,229 * 1/2001 Kim ..... 53/155

* cited by examiner

*Primary Examiner*—Peter Vo
*Assistant Examiner*—John Paradiso
(74) *Attorney, Agent, or Firm*—John K. Park; Park & Sutton LLP

(57) ABSTRACT

An automatic tablet dispenser comprising a tablet dropping unit having a drum communicating with a plurality of release holes which open to a plurality of tablet cassettes storing therein and releasing therefrom a measured quantity of tablets, wherein each of the tablet cassettes comprises a medicine case having a cylindrical opening through a lower portion thereof, a cylindrical rotor having an upper surface and a vertically formed outer periphery along which is formed a plurality of guide teeth having insert openings alternately formed among the guide teeth, a male gear disposed below the medicine case and rotatably engaged to the cylindrical rotor so that the cylindrical rotor can be rotated in correspondence to the male gear, and a vertically raised protrusion formed on the central surface portion of the upper surface of the rotor so as to smoothly agitate the tablets received in the medicine case and prevent the tablets from tangling together with the waved guide while allowing the tablets to be evenly loaded into the each insert opening when the rotor is rotated by the male gear.

9 Claims, 5 Drawing Sheets

TABLET CASSETTE FOR AUTOMATIC TABLET SORTING AND COUNTING MACHINE

RELATED APPLICATION

This application is a continuation-in-part of U.S. patent application Ser. No. 09/353,199 filed Jul. 14, 1999, now U.S Pat. No. 6,170,229.

BACKGROUND OF THE INVENTION

1. Field of Invention

The present utility model relates to a tablet cassette for an automatic tablet sorting and counting machine, and more specifically to an improved tablet cassette which is capable of facilitating a tablet packaging operation in a packaging unit by supplying to an output port of a drum as much quantity as instructed in a prescription, in correspondence to information input to the automatic tablet dispenser.

2. Description of the Prior Art

Generally, automatic tablet dispensers are employed in hospitals and drugstores to automate the output and assembly of corresponding tablets when the prescription is input into a computer, and serves to dispense the per-dosage assembled tablets.

Such an automatic tablet dispensing system includes: a main computer for enabling an appropriate prescription on the basis of proper medicine, intake method, daily intake frequency and intake duration depending upon each patient; a tablet dropping unit having a plurality of tablet cassettes and a drum for storing therein and releasing therefrom the tablets in correspondence to the prescription set up in the computer; and a packaging unit disposed below the tablet dropping unit and serving to package the output tablets and releasing the same to an exterior of the automatic tablet dispenser.

The packaging unit is made up of: a release hopper for assembling the tablets being dropped from the tablet drop unit; a heater assembly for packaging the tablets being discharged through the release hopper; a printer for printing respective information on packaging paper; and a release conveyer for externally discharging the medicine bags containing tablets.

Meanwhile, a tablet cassette serves to discharge to-be-packaged tablets on the basis of information input in the main computer. In general, the tablet cassette is comprised of a driving unit, a tablet case and a rotor, wherein the conventional tablet cassette includes a slanted rotor which rotates in accordance with the driving unit while contained in the tablet cassette.

Although a predetermined space sufficient to house the tablets therein is provided from the bottom surface of the tablet case, the room for the rotor and tablet case relatively becomes narrow due to the assembly clearance which occurs during the assembly of the driving unit, medicine case and rotor, thereby disadvantageously incurring difficulty in tablet release.

That is, a space is provided between a plurality of guide teeth formed along the outer periphery of the rotor, wherein the tablets are flowed into the space one by one and released by the rotor through the outlet and the hopper formed in the medicine case and the driving unit onto the drum.

As described above, the tablets should be smoothly supplied using the rotor rotated by the motor while contained in the medicine case but the conventional system has a disadvantage in that, since the space between the rotor and the medicine case cannot be constantly maintained during the assembly or for other reasons, a timely release of the tablets may not be accomplished resulting from jamming or tangling when the tablets in the medicine case are supplied toward the rotor.

In particular, the identical medicine cases are provided in fixed measurement regardless of tablet size, thereby differentiating quantity received in each case depending upon tablet sorts and size and accordingly requiring frequent tablet supplementation.

Further, when a large quantity of tablets are contained resulting from smallness of the tablets, the release duration becomes relatively larger, whereby the contained tablets may be subject to moisture and deformation.

SUMMARY OF THE INVENTION

The present utility model is contrived to overcome the conventional disadvantages. Therefore, it is an object to provide an automatic tablet dispensing system according to the utility model, capable of easily adjusting the size of a medicine case, preventing the internally contained medicine from deforming, and facilitating the tablet release by improving function of a rotor related thereto.

To achieve the above-described object, an improved automatic tablet dispenser comprising a tablet dropping unit having a drum communicating with a plurality of release holes which open to a plurality of tablet cassettes storing therein and releasing therefrom a measured quantity of tablets, wherein each of said tablet cassettes comprises: a medicine case having a cylindrical opening through a lower portion thereof; a cylindrical rotor having an upper surface and a vertically formed outer periphery, wherein the upper surface has a central portion, wherein a plurality of guide teeth are formed along the outer periphery, wherein a plurality of insert openings are alternately formed among the guide teeth, wherein the cylindrical rotor is rotatably introduced through the cylindrical opening of the medicine case and serves to temporarily maintain the tablets within the medicine case, and wherein a waved guide having a vertex at the center thereof is formed on the upper surface of the cylindrical rotor to guide the tablets into the insert openings without tangling, the waved guide is conically tapered in acclivity toward the vertex which belongs to the central portion of the upper surface, wherein the waved guide is partitioned into a plurality of sectors respectively defined by the vertex, two side lines each initiating from the vertex, and an arc sectioned from a circumference of the waved guide, wherein the sectors are alternately raised and flattened; a male gear disposed below the medicine case and rotatably engaged to the cylindrical rotor so that the cylindrical rotor can be rotated in correspondence to the male gear, whereby the tablets maintained in the medicine case are serially loaded in each of the insert openings and the measured quantity of the tablets are controllably dropped into a corresponding one of the release holes; and a vertically raised protrusion formed on the central surface portion of said upper surface of said rotor so as to smoothly agitate the tablets received in the medicine case and prevent said tablets from tangling together with said waved guide while allowing the tablets to be evenly loaded into said each insert opening when the rotor is rotated by the male gear.

An advantage of the present invention is to smoothly load the tablets temporarily maintained in the medicine case downwardly into each of the insert openings by providing the vertically raised protrusion on the vertex of the waved guide, wherein each of the alternately raised and flatted sectors together with the protrusion further escalates the smooth loading of the tablets into the insert openings. Another advantage is to enable the protrusion and the alternately raised and flattened sectors to prevent an unwanted tablet deformation such as indentation, which may occur due to tablet tangling and weight pressure of the randomly stacked tablets in the medicine case.

Although the present invention is briefly summarized, the fuller understanding of the invention can be obtained by the following drawings, detailed description and appended claims.

BRIEF DESCIPTION OF THE DRAWINGS

These and other features, aspects and advantages of the present invention will become better understood with reference to the accompanying drawings, wherein.

Figure 4:
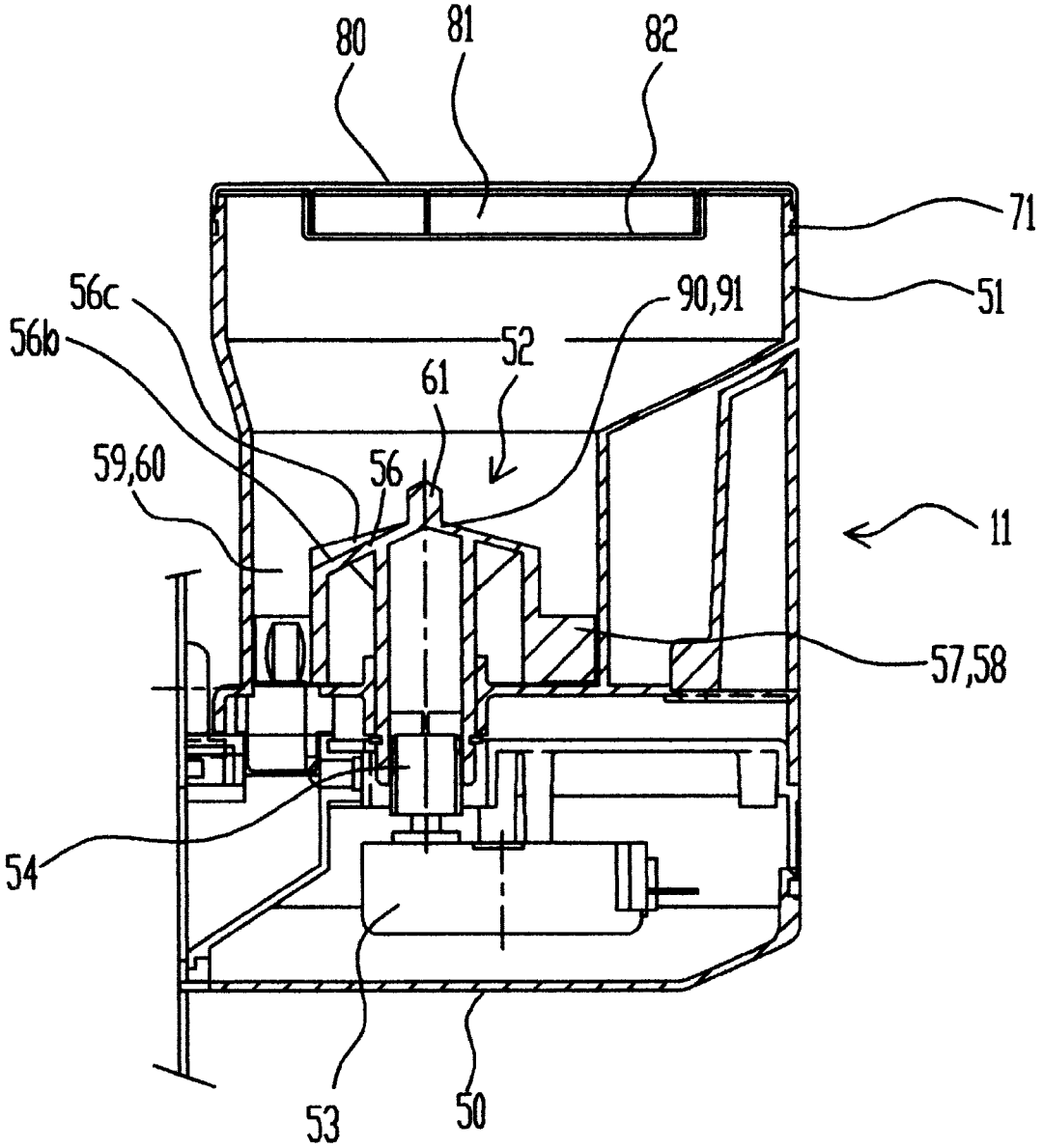
Figure 5:
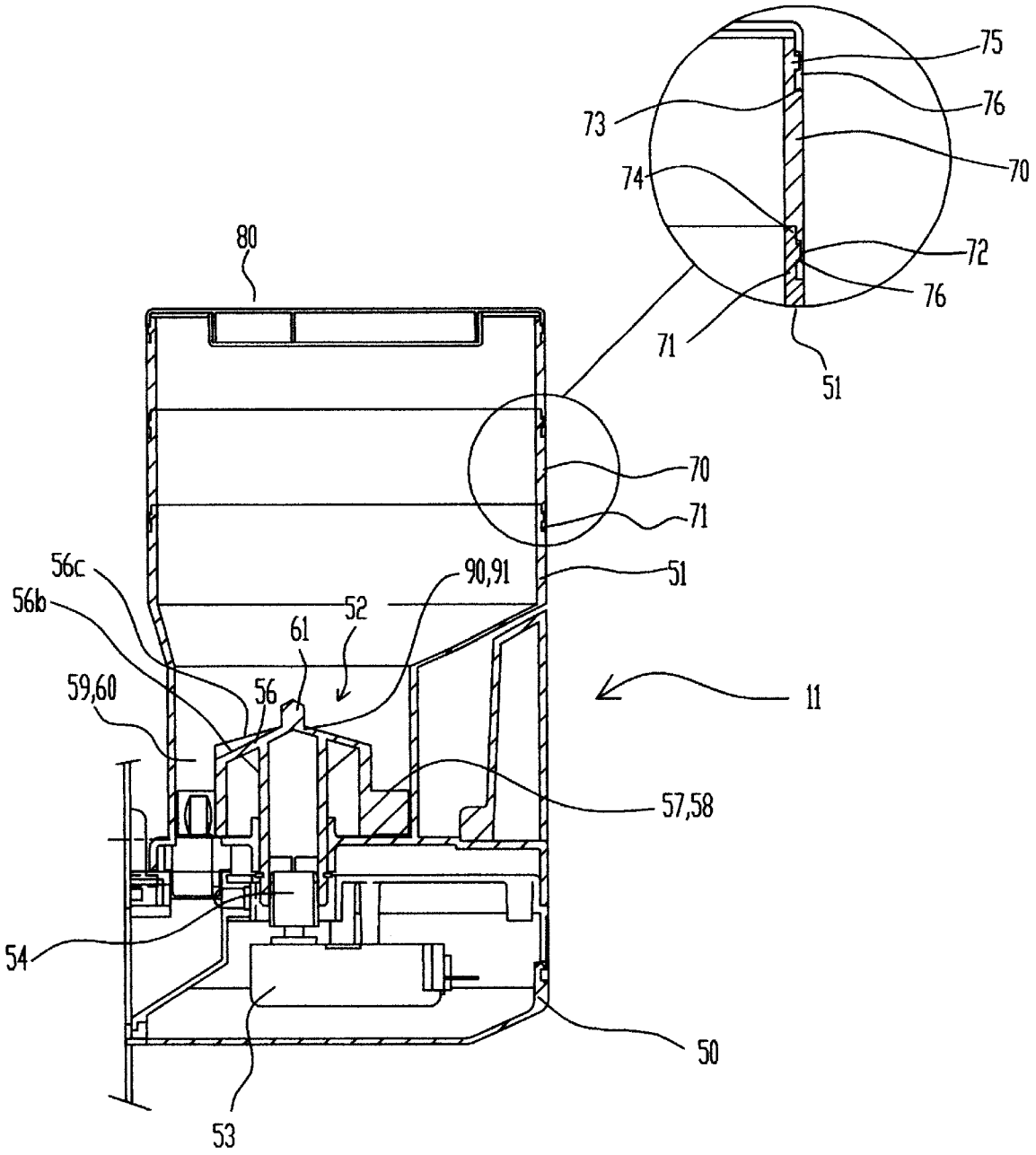

FIG. 4 is a cross-sectional view illustrating the assembly of a tablet cassette for an automatic tablet dispenser according to the present utility model; and FIG. 5 is a is a cross-sectional view illustrating a tablet cassette for an automatic tablet dispenser according to the present utility model, wherein the capacity of the medicine case is increased by connecting an auxiliary case to the tablet cassette.

DETAILED DESCRIPTION OF THE PREFERRED EMBODIMENTS

With reference to the accompanying drawings, the present utility model will now be described.

Figure 1:
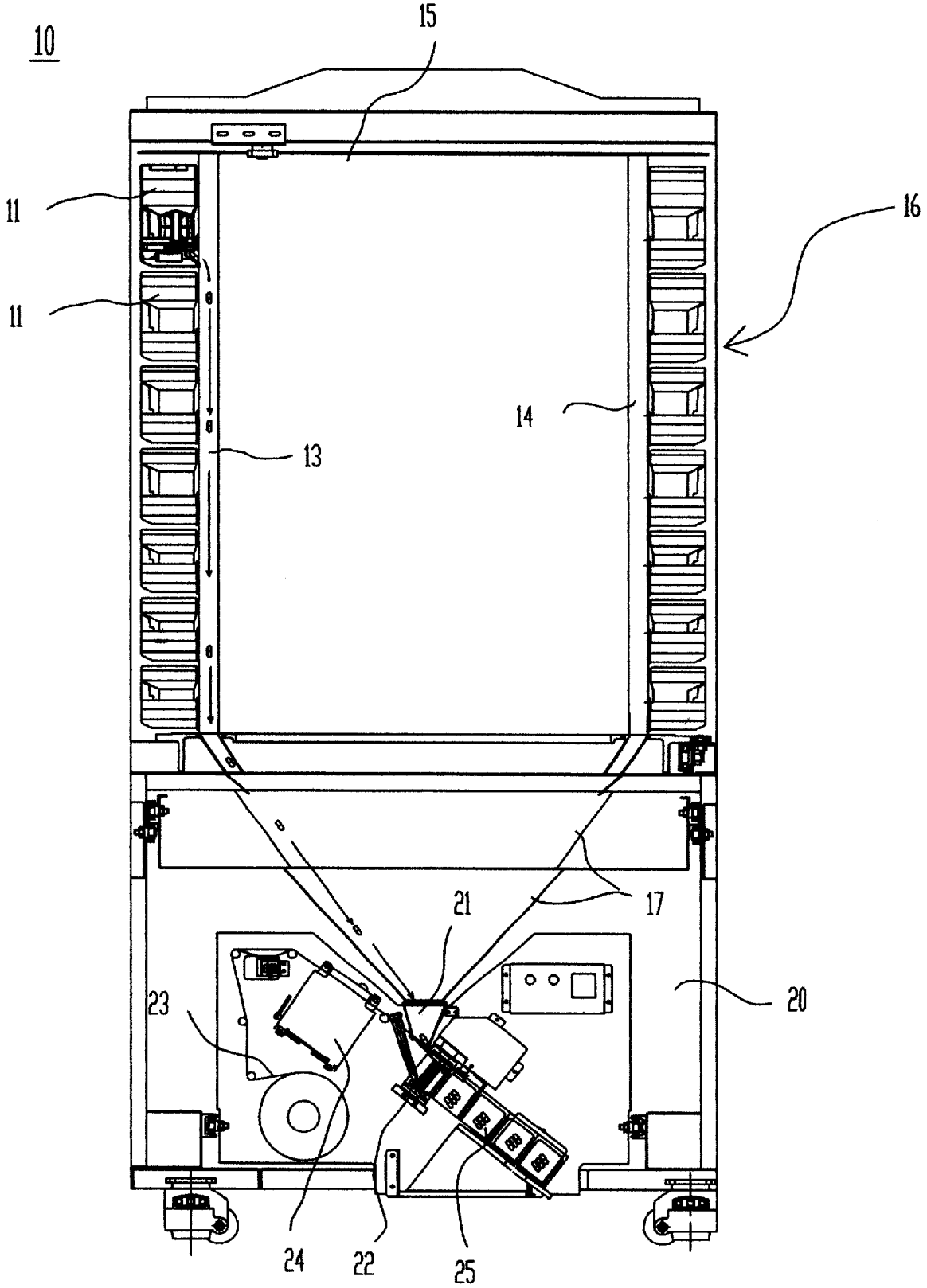
FIG. 1 is a schematic cross-sectional view illustrating a general automatic tablet dispenser.
Figure 2:
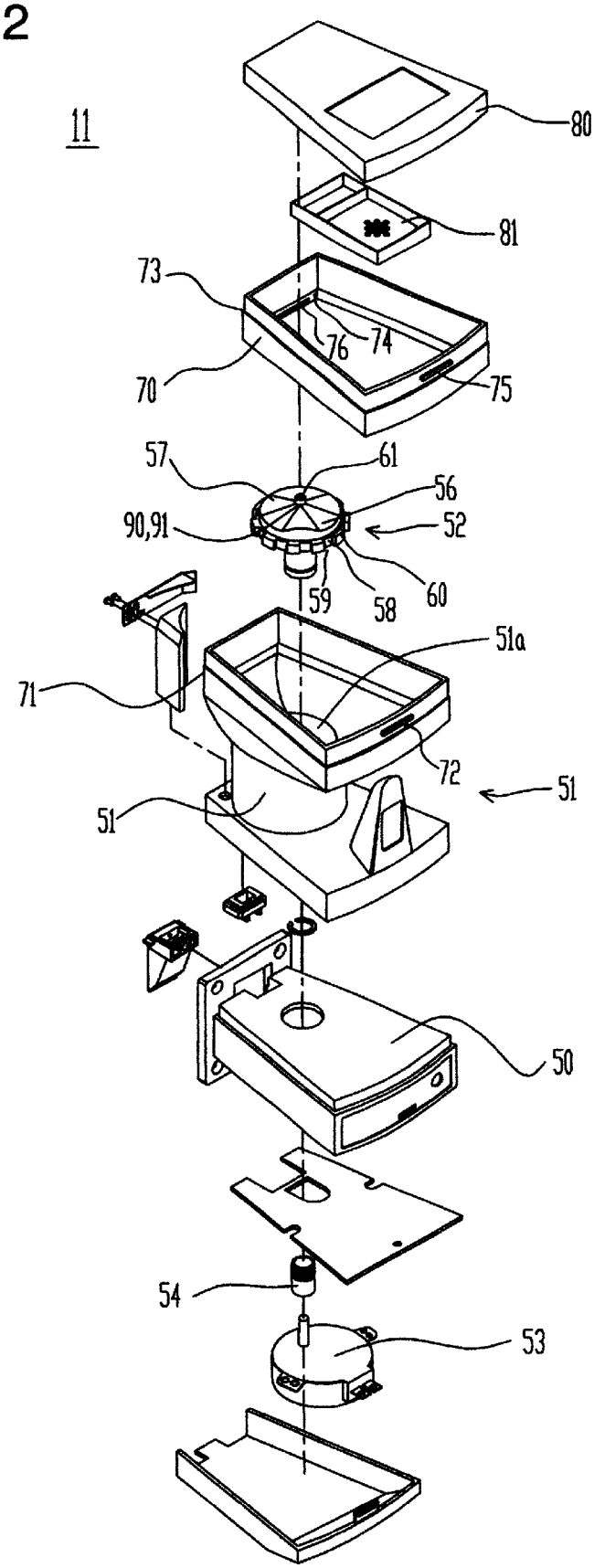
FIG. 2 is an exploded perspective view illustrating a tablet cassette for an automatic tablet dispenser according to the present utility model.
Figure 3:
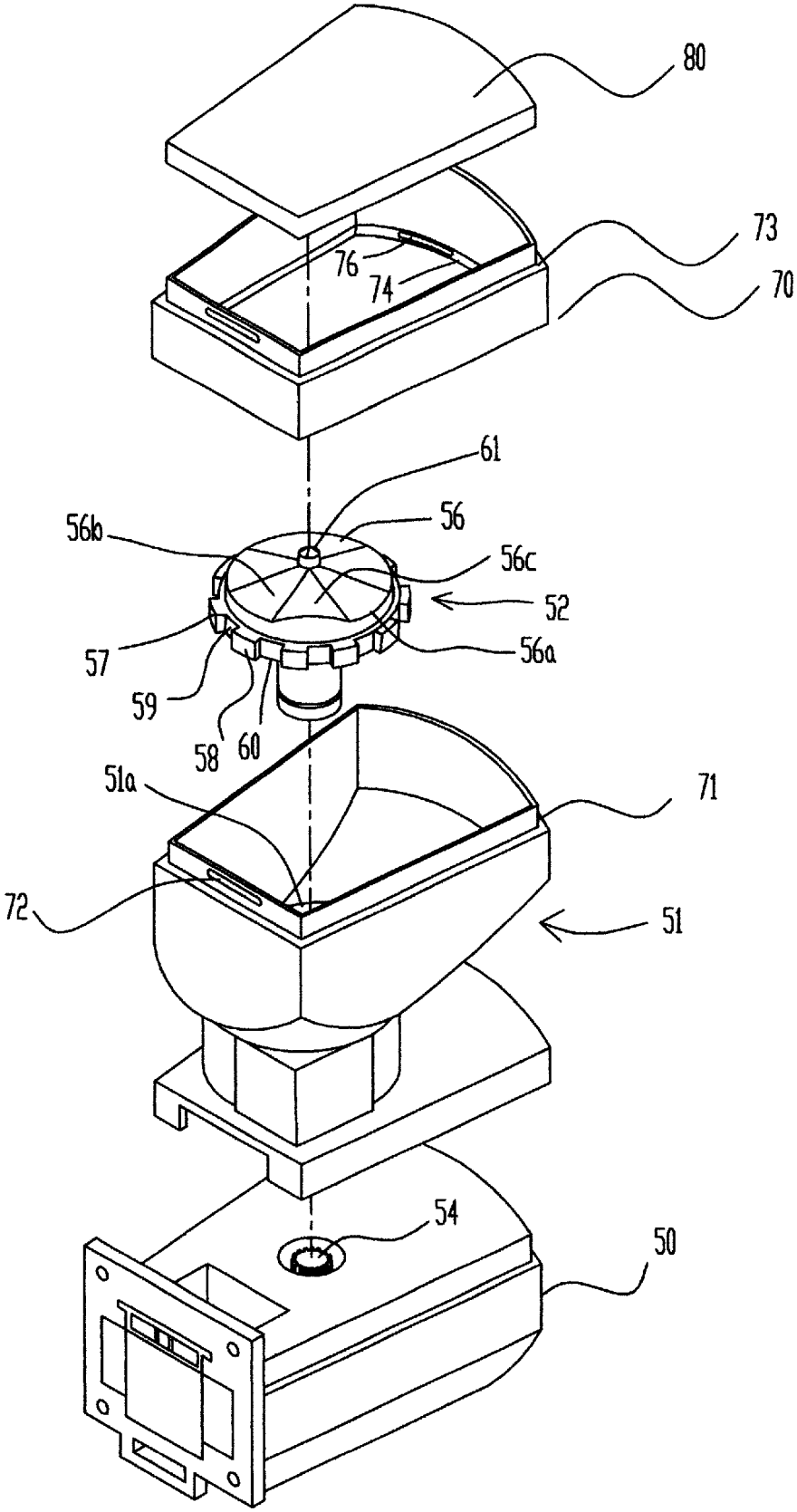
FIG. 3 is an exploded perspective view detailing the cylindrical rotor and the medicine case in FIG. 2.

As shown in FIG. 1, an automatic tablet dispenser 10 is comprised of a tablet dropping unit 16 including a cylindrical drum 15 having release holes 13, 14 engaged thereto so as to communicate a plurality of tablet cassettes 11 which respectively store therein tablets and release a measured quantity therefrom, through the outer periphery of the release holes 13, 14, so that the tablets released from the tablet cassettes 11 are dropped through the holes 13, 14.

Below the tablet dropping unit 16 there is provided a guide hopper 17 for safely guiding the tablets being released through the release holes 13, 14 so that the tablets may not be dispersed.

A packaging unit 20 is disposed below the guide hopper 17 to package and discharge the released tablets outside the automatic tablet dispenser 10.

The packaging unit 20 includes a discharge hopper 21 for gathering the tablets dropped from the tablet dropping unit 16, a heater assembly 22 for packaging the tablets released through the discharge hopper 21, a printer 24 for printing respective information on the packaging paper 23, and a discharge conveyer 25 for externally releasing respective tablet-packaged bags. The automatic tablet dispenser 10 is controlled by the main computer informed of an appropriate prescription for a target patient which includes proper medicine, intake method, daily intake frequency, intake duration, etc.

In such an automatic tablet dispenser 10, each tablet cassette 11 releases the to-be-packaged tablets on the ground of the information input into the main computer.

As further shown in FIGS. 2 through 5, the tablet cassettes 11 are respectively formed of a driving unit 50, a medicine case 51 and a rotor 52.

The present utility model improves the respective function of the medicine case 51 and the rotor 52 of the tablet cassette 11, thereby facilitating the operation of tablet release and preventing deformation of the medicine.

Specifically, the rotor 52 received in the medicine case 51 is vertically engaged onto a male gear 54 fixed into a shaft of the motor 53 which is disposed within the driving unit 50 so as to prevent a space from generating between the bottom surfaces of the rotor 52 and the medicine case 51, thereby improving tablet releasing capability. That is, the medicine case 51 has a cylindrical opening 51*a* formed through a lower portion thereof and the rotor 52 is rotatably introduced through the cylindrical opening 51*a* to temporarily maintain the tablets within the medicine case 51.

A waved guide 56 is formed on an upper surface 56*a* of the cylindrical rotor 52 and has a vertex 91 so as to smoothly agitate the received tablets and prevent from tangling. The waved guide 56 is conically tapered toward a central portion 90 of the upper surface 56*a* of the rotor 52 and has a plurality of sectors 56*b*, 56*c* in alternate formation of flattened sectors 56*b* and raised sectors 56*c*. Each arc of the flattened sectors 56*b* and raised sectors 56*c* may form a circumference of the rotor 52. Here, the vertex 91 may be equal to a central portion 90 of the upper surface 56*a*. The plurality of sectors 56*b*, 56*c* are respectively defined by the vertex 91, two side lines each initiating from the vertex 91, and an arc sectioned from a circumference of the waved guide 56, wherein the sectors 56*b*, 56*c* are alternately raised and flattened.

For a better performance, an angle subtended at the two side lines of each raised sector 56*c* is larger than that of each flattened sector 56*b* and ranges between about 50 degrees and about 80 degrees. The most preferred combination of the sectors 56*b*, 56*c* is a set of three raised sectors 56*b* and three flattened sectors 56*c*.

A plurality of guide teeth 57, 58 are formed with the same interval spaced from each other. A plurality of tablet insert openings 59, 60 are correspondingly formed between the guide teeth 57, 58 in oneness to respectively receive one tablet therethrough. A vertically raised protrusion 61 is upwardly formed on an upper central surface portion of the cylindrical rotor 52 so as to facilitate distribution of the tablets into the openings 59, 60. The vertically raised protrusion 61 allows the tablets to be evenly loaded into each insert opening 59, 60 when the rotor 52 is rotated by the male gear 54. A to preferred dimension of the protrusion 61 is between about 0.2 inches and 0.5 inches in height, and between about 0.1 inches and about 0.3 inches in diameter when formed in cylindrical shape. The protrusion 61 may be formed in cylinder, four-sided pillar, triangular prism and any of other multilateral pillars.

More than one auxiliary case 70 may be vertically stacked onto the upper portion of the medicine case wall 51 so as to simultaneously accommodate therein a larger quantity of tablets in correspondence to size, sorts and usage frequency of the tablets.

For that purpose, an engagement step 71 is formed along the upper periphery of the medicine case 51 and thrust bumps 72 are formed on the front and rear surface of the combination step 71.

The engagement steps 73, 74 are formed on the upper and lower end of the combined auxiliary case 70, whereas the lower engagement step 74 is formed inside and the upper engagement step 73 is formed outside, thereby realizing a reciprocal engagement.

Thrust bumps 75 and thrust grooves 76 are formed in oneness at the engagement steps 73, 74 of the auxiliary case 70 so as to maintain the reciprocal engagement state, whereas the thrust bumps 75 are formed at the upper engagement step 73 and the thrust grooves 76 are formed at the inner combination step 74.

A cover 80 is engaged to the upper portion of the medicine case 51. A receivable compartment 81 is formed underneath the cover 80 and a porous covering 82 is provided to cover the compartment 81. The compartment 81 may contain preservatives and demoisturants such as Silica Gel (brand name) so as to facilitate dehydration and prevent deformation of the medicine.

The tablet cassettes 11 according to the present utility model are fixed to the drum 15 as applied when using a common tablet cassette, and the packaging operation is completed in the lower packaging unit 20 by releasing the tablets received in the tablets cassette 11 under the control of the main computer so that the tablets are released outside the automatic tablet dispenser 10, wherein the operating steps are identical to those of the conventional art and the detailed explanation will be omitted accordingly. Instead, the advantages of the tablet cassette 11 will now be intensively described.

The tablet cassette 11 according to the present utility model prevents tablets from being tangled since no space is generated between the cylindrical rotor 52 and the bottom surface of the medicine case 51, wherein the tablet cassette 11 has the rotor 52 inserted therein and rotated by the male gear 54 engaged to the motor 53 in the driving unit 50 so as to release one tablet.

Particularly, the waved guide 56 formed along the upper surface 56*a* of the rotor 52 enables the medicine case 51 to receive the tablets and evenly distribute the received tablets into the insert openings 59, 60, and an intensive supply of the tablets into the tablet insert openings 59, 60 between the guide teeth 57, 58 formed along the outer periphery of the rotor 52 without tangling is accordingly prevented resulting from a smooth agitation of the tablets.

Also, the medicine case 51 engages the auxiliary case 70 in multi-step to an upper end of the medicine case 51 in correspondence to size, sorts and usage frequency of the target tablets so as to increase tablet capacity, thereby overcoming the disadvantages in that the medicine case 51 should be frequently changed and the tablets should be supplemented.

Further, protection agents such as preservatives or demoisturants are received into the receivable recess 81 formed in oneness at the cover 80 which is engaged to the upper end of the medicine case 51 or the auxiliary case 70, thereby preventing deformation of the tablets received in the medicine case 51.

One of the advantages of the present invention is to smoothly load the tablets temporarily maintained in the medicine case 51 downwardly into each of the insert openings 59, 60 by providing the vertically raised protrusion 61 on the vertex of the waved guide 56, wherein each of the alternately raised and flatted sectors 56*b*, 56*c* together with the protrusion 61 further escalates the smooth loading of the tablets into the insert openings 59, 60. Another advantage is to enable the protrusion 61 and the alternately raised and flattened sectors 56*b*, 56*c* to prevent an unwanted tablet deformation such as indentation, which may occur due to tablet tangling and weight pressure of the randomly stacked tablets in the medicine case 51.

As discussed above, the system according to the present utility model improves efficiency of tablet dispensing operation by smoothly releasing the tablets internally received by upgrading the function of the rotor, while preventing the internally received tablets from being deformed.

Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. An improved automatic tablet dispenser comprising a tablet dropping unit having a drum communicating with a plurality of release holes which open to a plurality of tablet cassettes storing therein and releasing therefrom a measured quantity of tablets, wherein each of said tablet cassettes comprising:

a) a medicine case having a cylindrical opening through a lower portion thereof;

b) a cylindrical rotor having an upper surface and a vertically formed outer periphery, wherein the upper surface has a central portion, wherein a plurality of guide teeth are formed along the outer periphery, wherein a plurality of insert openings are alternately formed among the guide teeth, wherein the cylindrical rotor is rotatably introduced through the cylindrical opening of the medicine case and serves to temporarily maintain the tablets within the medicine case, and wherein a waved guide having a vertex at the center thereof is formed on the upper surface of the cylindrical rotor to guide the tablets into the insert openings without tangling, the waved guide is conically tapered in acclivity toward the vertex which belongs to the central portion of the upper surface, wherein the waved guide is partitioned into a plurality of sectors respectively defined by the vertex, two side lines each initiating from the vertex, and an arc sectioned from a circumference of the waved guide, wherein the sectors are alternately raised and flattened;

c) a male gear disposed below the medicine case and rotatably engaged to the cylindrical rotor so that the cylindrical rotor can be rotated in correspondence to the male gear, whereby the tablets maintained in the medicine case are serially loaded in each of the insert openings and the measured quantity of the tablets are controllably dropped into a corresponding one of the release holes; and d) a vertically raised protrusion formed on the central surface portion of said upper surface of said rotor so as to smoothly agitate the tablets received in the medicine case and prevent said tablets from tangling together with said waved guide while allowing the tablets to be evenly loaded into said each insert opening when the rotor is rotated by the male gear.

2. The automatic tablet dispenser of claim 1, wherein the plurality of sectors comprise three raised sectors and three flattened sectors.

3. The automatic tablet dispenser of claim 1, wherein the vertically raised protrusion is about 0.3 inches high.

4. The automatic tablet dispenser of claim 1, wherein the vertically raised protrusion is between about 0.1 and 0.3 inches in diameter.

5. The automatic tablet dispenser of claim 3, wherein the vertically raised protrusion is between about 0.1 and 0.3 inches in diameter.

6. The automatic tablet dispenser of claim 4, wherein the vertically raised protrusion is formed in four-sided pillar.

7. The automatic tablet dispenser of claim 5, wherein the vertically raised protrusion is formed in four-sided pillar.

8. The automatic tablet dispenser of claim 1, wherein an angle subtended by the two side lines of said each raised sector is larger than that of said each flattened sector.

9. The tablet cassette of claim 8, wherein the angle subtended by the two side lines of said each raised sector is about 65 degrees.

* * * * *